United States Patent [19]

Thomas

[11] Patent Number: 5,023,980

[45] Date of Patent: Jun. 18, 1991

[54] FREE RUNNING CINCHING LATCH PLATE

[75] Inventor: Rudy V. Thomas, Sterling Heights, Mich.

[73] Assignee: Allied-Signal Inc., Morris Township, Morris County, N.J.

[21] Appl. No.: 401,330

[22] Filed: Aug. 31, 1989

[51] Int. Cl.[5] ..... A44B 11/10

[52] U.S. Cl. ..... 24/196; 24/171

[58] Field of Search ..... 24/171, 307, 194, 323, 24/196; 297/468

[56] References Cited

U.S. PATENT DOCUMENTS

| | | | |
|---|---|---|---|
| 3,408,707 | 11/1968 | Hemphill | 24/196 X |
| 3,898,715 | 8/1975 | Balder | 24/196 |
| 4,473,926 | 10/1984 | Ono | 24/196 |
| 4,871,190 | 10/1989 | Willey | 297/468 X |
| 4,878,272 | 11/1989 | Kotikovsky et al. | 297/468 X |

*Primary Examiner*—James R. Brittain

[57] ABSTRACT

A latch plate assembly (10) comprising: a plate (12) having formed at one end thereof a tongue (14) and at an opposite end a back portion (22), the back portion (22) comprising open ends (112*a,b*) and an open recess (50; 30), the back portion including radially extending opposing openings (52,54) through which may be received a substantially flat seat belt webbing (60); a lock bar (80) moveable between first and second positions releasing and compressing the webbing (60); a cap (90) for enclosing the open recess (50; 30) and open ends (112*a,b*) including a sloping surface for positioning the lock bar (80) into compressive engagement with the webbing (60) and for slideably securing the lock bar (80) therein.

7 Claims, 2 Drawing Sheets

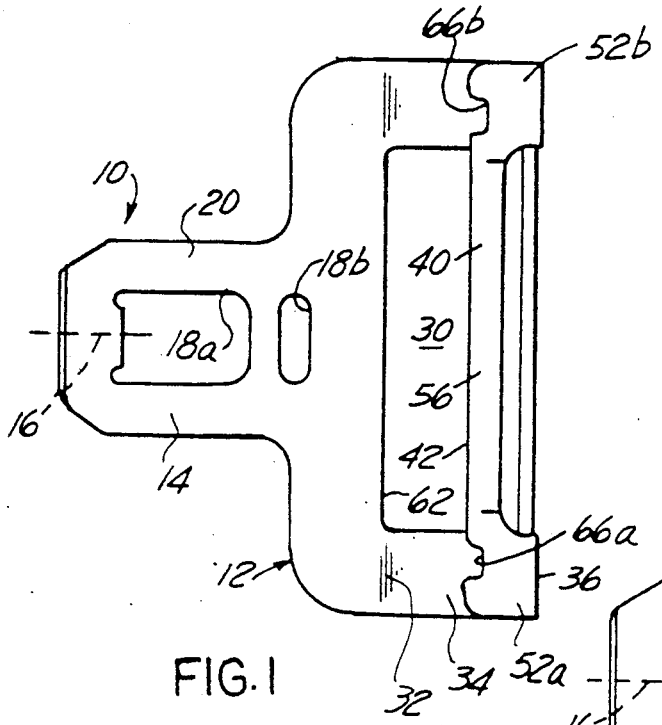
FIG. 1
FIG. 2
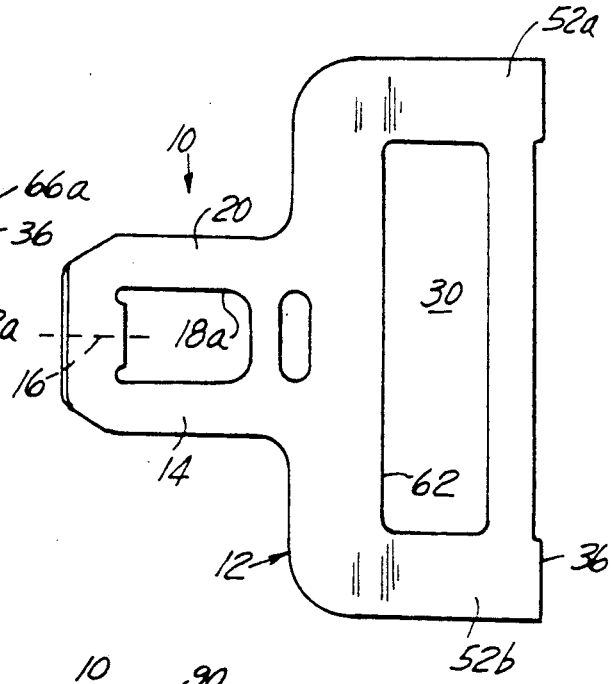
FIG. 3
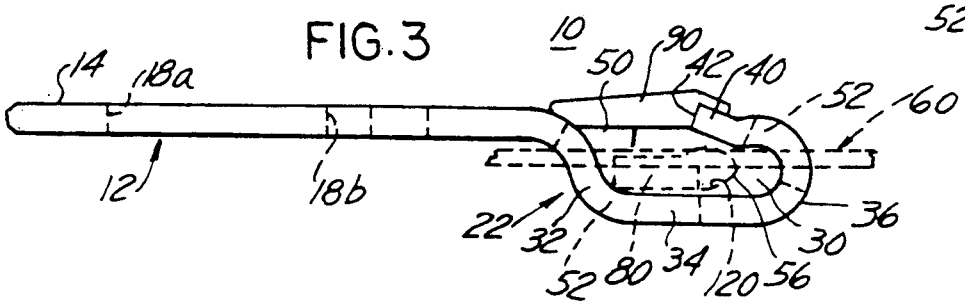
FIG. 4
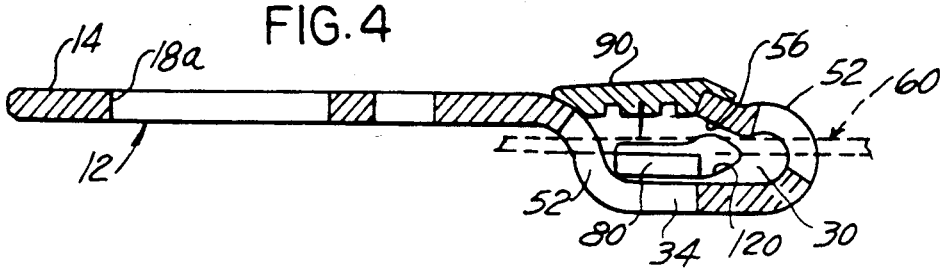

FIG. 5
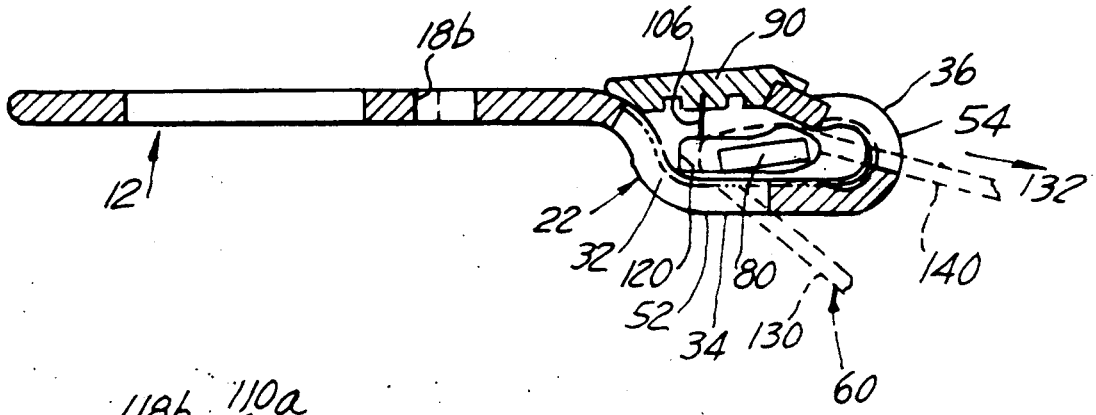
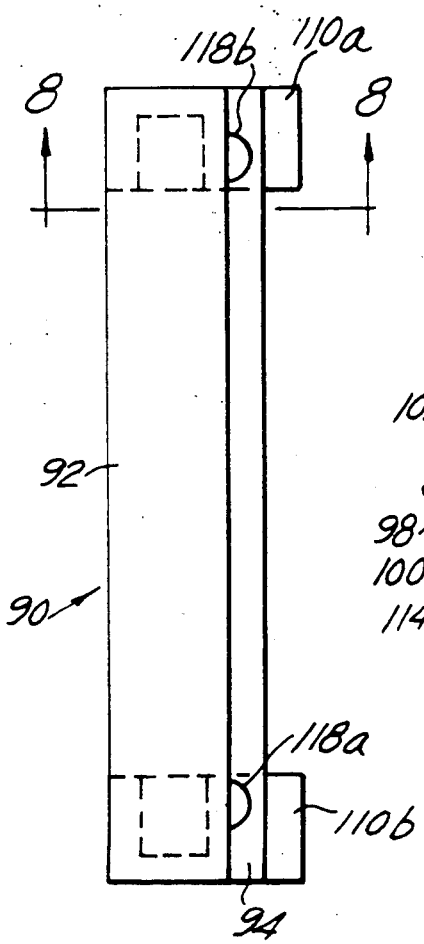
FIG. 6
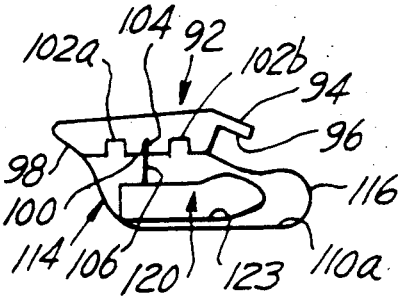
FIG. 8
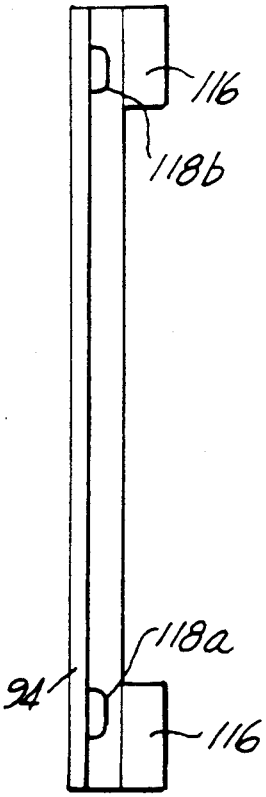
FIG. 7

FREE RUNNING CINCHING LATCH PLATE

BACKGROUND AND SUMMARY OF INVENTION

The present invention is related to automotive safety restraint systems and, more particularly, to a low-friction, self-locking latch plate or tongue assembly for a 3-point seat belt system.

Self-locking tongues or latch plates are commonly used to tighten and secure the shoulder and/or portions of a seat belt about the occupant. Such latch plate or tongue mechanisms find application with seat belts for center seats as well as in a continuous type seat belt system having retractors that are commonly used in outboard seating positions. These self-locking tongues or latch plates must be capable of sliding on the webbing in order to provide a proper fit over the occupant and must be able to lock during crash positions to prevent loosening of the lap belt portion and to prevent slack in the shoulder belt portion which may cause a direct transfer of additional forces to the lap belt portion.

In typical operation, the occupant slides the latch plate along the webbing for proper fit. Once secured in place these devices generate sufficient friction to maintain the webbing in place. Upon disconnection of the tongue from a buckle the seat belt retractor will wind up the loose portion of the seat belt webbing. However, due to the inherent friction in many of these prior devices, the latch plate will stop when it reaches the retractor if mounted on the floor; or will stop when the tongue engages a web guide normally mounted to the vehicle's pillar or door at shoulder height. As a result the seat belt webbing is not fully retracted and dangles loose. The loose webbing presents an inconvenience in that it may become caught in the door or cause an entanglement with the occupant. U.S. Pat. No. 4,551,889 presents a self-locking tongue in which the friction between the tongue and the seat belt webbing in its unbuckled state is reduced, thereby permitting the webbing to slide through the tongue during retraction thereof to permit the webbing to become fully retracted thereby elimating the above discussed problems.

It is an object of the present invention to provide a self-locking latch plate having a negligible friction coefficient to permit the seat belt webbing to be fully retracted when not in use. A further object of the present invention is to provide a latch plate wherein some functions correctly with or without an associated cover and lock bar.

Accordingly, the invention comprises: a latch plate assembly comprising: a plate having formed at one end thereof a tongue and at an opposite end a back portion. The back portion comprising open ends and an open recess and including radially extending opposing openings through which may be received a substantially flat seat belt webbing. Lock bar means are provided and moveable between first and second positions for releasing and compressing the webbing. The assembly additionally includes cap means for enclosing the open recess and open ends including guide means for positioning the lock bar means into compressive engagement with the webbing and for slideably securing the lock bar (80) therein.

Many other objects and purposes of the invention will be clear from the following detailed description of the drawings.

BRIEF DESCRIPTION OF THE DRAWINGS

In the drawing;

FIG. 1 is a top view of a partially assembled latch plate.

FIG. 2 is a bottom view of a the latch plate of FIG. 1.

FIG. 3 is a side plan view of the latch plate of FIG. 1 or 2.

FIG. 4 is a cross sectional view of a latch plate assembly in its released or non-cinching position.

FIG. 5 is an additional cross section of the latch plate assembly in its locked or cinched position.

FIGS. 6–8 illustrate various views of the cover.

DETAILED DESCRIPTION OF THE DRAWINGS

With reference to the Figures there is shown a self-locking latch plate assembly 10. The assembly 10 as shown in FIGS. 1–3 comprises a latch plate 12 having a generally planar tongue 14 which extends forwardly, parallel to an axis 16. A plurality of openings 18*a* and 18*b* are provided within the planar portion 20 of the latch plate 12 for attachment to a buckle (not shown). The plate 12, rearward of the tongue 14, extends perpendicular to the axis 16 to define a wider back portion 22. The back portion 22 is curled about itself to form a radially extending, partially open recess 30. More particularly, the back portion 22 includes a transition surface 32 that extends below the plane of the tongue 14, a generally flat portion 34 extending rearward of the transition surface 32 and oriented substantially parallel to the plane of the tongue 14 and an end portion 36 bent about itself and terminating in an end member 40 having an end surface 42. The end member 40 is oriented at a slight upward angle to the plane of the tongue 14 to facilitate receipt of a cap.

As can be seen, the end member 40, i.e., end surface 42, is spaced from the transition surface of the plate forming a radially extending channel 50 located at the upper portion of the recess 30. As can be seen, the respective ends 52*a* and *b* of the end portion 36 are formed as a smooth, continuous arcuate surface. The end portion 36 further includes a pair of notches 66*a* and 66*b*, in the upper end surface 42 of each respective end, the purpose of which is discussed below.

The latch plate 12 further includes a plurality of apertures to permit receipt of a seat belt webbing 60. More particularly, one radially extending aperture 52 is formed in the transition surface 32 while another aperture 54 is formed in the end portion 36.

These apertures 52 and 54 are oriented relative to one another to permit the seat belt 60 to enter and exit the latch plate when unbuckled, generally parallel to the plane of the tongue 14. The middle portion 56 of the end member 40 above the opening 54, is angled or bent downwardly to reduce the cross-sectional open area of the aperture 54 to be somewhat larger than the height of the webbing 60.

Loosely received within the open recess 30 formed by the bent over portions of the latch plate 12 is a lock bar 80. The lock bar 80 extends transversely to the axis 16 of the tongue and in the free running or non-cinching mode of operation will seek a position at the left side of the flat portion 34 proximate the transition surface 32 as shown in FIGS. 3 and 4. Typically, during the free running or non-cinching mode of operation the webbing 60 will be retracted by a retractor. As such, and upon retraction, the latch plate assembly will assume a vertical, downwardly pointing orientation and the lock bar 80 will be urged downwardly relative to the flat portion 34, by gravity toward the transition surface 32.

The lock bar 80 is maintained within the latch plate 12 by a cover 90. The figures illustrate a cap of integral construction, however a multi-piece cap is within the scope of the present invention.

The cap 90 comprises a cover plate 92 having a rearward extending ledge 94 forming a shoulder 96 adapted to butt against the end member 40. The front undersurface 98 is accurately shaped and conformal to the transition surface 32. The bottom 100 of the cover plate includes a plurality of partially extending slots 102*a,b* which are primarily provided to remove unnecessary material from the cap 90. Inserted within another slot 104 is an optional rubber wiper 106 which extends towards and lightly engages the webbing 60. Positioned below the cover plate 92 at its ends are respective inserts 110*a* and *b* formed integrally therewith. Each insert is adapted to be secured within respective ends 52*a,b* of the back plate portion 22. Extending from the cover plate 92 are tabs 118*a* and *b*.

As can be seen more specifically in FIG. 8, the forward facing surface 114 of each insert 110 is arcuately shaped and smoothly extends from the outboard portions of the undersurface 98 as to engage the transition surface 32. The rearward facing surface 116 is arcuately shaped to fit within the outboard regions of the curved end portion 36. During assembly the cap 90 is slid into the latch plate 12 through either open end 52 of the end portion 36 with the tabs 118*a* and *b* fitting within the respective notches 66*a* and *b*.

The inserts 110 each comprise a generally hollow recess 120 into which is received a respective end of the lock bar 80. An inside lower surface 122 of the recess 120 defines a tapered surface or inclined bar guide 124. The surface of this bar guide extends rearwardly and upwardly relative to the flat portion 34 of the latch plate 12.

The cap 90, when in place within the latch plate 12, entrains the lock bar 80 therein with the ends of the lock bar 80 received within the respective recesses 120.

In operation the tongue plate assembly is inserted within a buckle (not shown) wherein a spring loaded pawl engages the latch aperture 18*a* in a known manner. In this condition the webbing 60 (see FIG. 5) is somewhat folded upon itself with the shoulder belt portion 140 exiting the latch plate assembly through the aperture 54 and the seat belt portion 130 of the webbing 60 exiting the aperture 62. To adjust the lap portion 130 of the seat belt webbing, the occupant would pull on the seat belt webbing in the direction of arrow 132 until the lap portion is snug fit about the hip region. The placement of the lock bar and its low coefficient of friction relative to the webbing, permits the outward extension of the webbing through the latch plate assembly. Having tightened the seat belt webbing and adjusted the shoulder belt webbing to its proper tension, the lock bar will be urged rearwardly (see FIG. 5) within the recess 120 and upwardly towards the bent surface (56) of the end portion 40 to entrain the webbing therein. In this position reaction forces on the seat belt webbing resulting from any forward motion of the occupant would be applied to the forward edge of the lock bar 80, urging it farther up the inclined surface of the bar guide 124 increasing the frictional forces between the lock bar and webbing preventing the loosening thereof.

In the event of a crash, the crash forces would be applied to both the lap and shoulder belt portions of the seat belt webbing which together would further displace the lock bar upwardly along the inclined surface 124. Crash forces applied to the lap and shoulder portions of the seat belt would positively entrain or cinch the lap belt in its existing position, preventing forward movement of the occupant.

When the latch plate assembly is unlatched from the buckle, the retractor will begin to retract the shoulder belt portion which, in turn, will urge the latch plate assembly towards the retractor. If the cover 90 does not include the wiper 106, the latch plate assembly 10 will be moved rearwardly as the webbing is retracted by the retractor. When the webbing 60 achieves its taut vertical configuration, latch plate assembly 10 will assume the relative (vertical) orientation similar to that shown in FIG. 4. The lock bar 80 will be urged downwardly from the tapered surface 124 by gravity and tend to release the webbing and the latch plate assembly 10 will typically attempt to slide down the webbing toward the floor of the vehicle. This downward motion can be controlled by installing a detent, button or stop on the webbing. If however, the cover 90 includes the wiper 106 then as the webbing is retracted the friction forces generated between the webbing and the lightly engaging wiper will cause the latch plate assembly to generally move with the webbing 60. As the latch plate assembly assumes a generally vertical position, the lock bar will tend to slide downwardly on the inclined surface 124, releasing the compressive force on the webbing, with the wiper still maintaining a very light bias on the webbing. When the latch plate assembly contacts the retractor or web guide its motion will be stopped, and the webbing will continue to be pulled through the latch plate assembly by virtue of the low coefficient of friction between the webbing and wiper permitting the webbing to become fully retracted.

A further feature of the present invention is that by virtue of construction the latch plate 12, it will function to adequately protect the occupant even if the cover 90 and lock bar 80 are removed.

Many changes and modifications in the above described embodiment of the invention can, of course, be carried out without departing from the scope thereof. Accordingly, that scope is intended to be limited only by the scope of the appended claims.

I claim:

1. A latch plate assembly comprising:

a plate having a tongue formed at one end thereof and at an opposite end a black portion, the back portion includes an end portion comprising open ends and defining an open recess;

the back portion including radially extending opposing openings through which may be received a substantially flat seat belt webbing;

lock bar means movable between first and second positions for releasing and compressing the webbing;

cap means for enclosing the open recess and open ends including guide means for positioning the lock bar means into compressive engagement with the webbing and for slidably securing the lock bar therein wherein the cap means includes first means for generating a frictional force of engagement with the webbing and a cap plate received in the open recess, opposingly situation inserts adapted to be received within the open ends of the back portion, each insert includes the guide means which compress a respective inwardly facing first recess into which respective ends of the lock bar means is received wherein each first recess includes a tapered surface such that as the lock bar means moves from the first position toward the second position, the lock bar means moves into compressive engagement with the webbing the wherein the webbing as same passes through the back portion is positioned between the cap means and the lock bar means.

2. The device as defined in claim 1 wherein the first means comprises a resilient wiper element.

3. The device as defined in claim 2 wherein the wiper element is fabricated of rubber.

4. A latch plate assembly comprising;

a plate defining a plane having formed at one end a tongue, a transition surface extending below the plane of the tongue, a substantially flat portion extending rearward of the transition surface and an end portion, opposite the one end, rolled over and a portion of which terminates in an angle relative to the plane of the tongue, the transition surface, flat portion and end portion extending substantially rearward of the tongue and cooperating to form an open recess, the transition surface and end portion including radially extending first and second openings to receive a webbing therethrough in a substantially flat orientation during a non-cinching mode;

a portion of the end portion, includes a rearward slope proximate the second opening to reduce the cross-sectional area thereof;

a bar loosely received into the open recess and entrained in part by the webbing when such webbing is looped about the bar and rearwardly tensioned;

cap means adapted to be received in respective side openings of the open recess for preventing the bar from moving therefrom, the cap means including a cap plate such that when in position such cap plate substantially encloses the top of the recess, the cap means including inserts each having a recess into which is received a respective end of the bar, each cap recess including a transition surface upwardly ramped relative to the flat portion of the plate and to the sloped portion such that when the webbing is in its tensioned condition the bar is urged along each transition surface to compressively clamp a portion of the webbing against a sloped portion of the end portion.

5. A latch plate assembly comprising:

a plate having a tongue formed at one end thereof and at an opposite end a back portion, the back portion includes an end portion comprising open ends and defining an open recess;

the back portion including radially extending opposing openings through which may be received a substantially flat seat belt webbing;

a lock bar means movable between first and second positions for releasing and compressing the webbing;

cap means for enclosing the open recess and open ends including guide mean for positioning the lock bar means into compressive engagement with the webbing and for slidably securing the lock bar therein and wherein the cap means includes first means for generating a frictional force of engagement with the webbing.

6. The device as defined in claim 5 wherein the first means comprises a resilient wiper element.

7. The device as defined in claim 6 wherein the wiper element is fabricated of rubber.

* * * * *